United States Patent [19]

Arata et al.

[11] Patent Number: 4,620,080

[45] Date of Patent: Oct. 28, 1986

[54] PLASMA JET GENERATING APPARATUS WITH PLASMA CONFINING VORTEX GENERATOR

[75] Inventors: Yoshiaki Arata, Amagasaki; Akira Kobayashi, Takatsuki, both of Japan

[73] Assignee: Nippon Steel Corporation, Tokyo, Japan

[21] Appl. No.: 748,421

[22] Filed: Jun. 25, 1985

[30] Foreign Application Priority Data

Jun. 27, 1984 [JP] Japan ..... 59-132783

[51] Int. Cl.[4] ..... B23K 9/00

[52] U.S. Cl. ..... 219/121 PP; 219/121 PQ; 219/121 PR; 313/231.51

[58] Field of Search ..... 219/121 PM, 121 PP, 219/121 PQ, 121 PN, 121 P, 74, 75; 313/231.31–231.51

[56] References Cited

U.S. PATENT DOCUMENTS 2,941,063 6/1960 Ducati et al. ..... 219/121 PP
3,149,222 9/1964 Giannini et al. ..... 219/121 PM
3,536,885 10/1970 Mitchell ..... 219/121 PQ
4,338,509 7/1982 Bartuska et al. ..... 219/121 PP

OTHER PUBLICATIONS

"Concept of Vortex Gas Tunnel and Application to High Temperature Plasma Production", Yoshiaki Arata, J. Phys. Soc. Japan, vol. 43, No. 3, Sep., 1977.

*Primary Examiner*—M. H. Paschall
*Attorney, Agent, or Firm*—Wenderoth, Lind & Ponack

[57] ABSTRACT

A plasma jet generating apparatus including a torch center electrode, a torch nozzle, a first DC source, and a vortex flow/discharge unit. The unit includes a second DC power source, a gas diverter nozzle, and a vortex flow chamber. The second DC power source is used to create a high temperature and high power plasma jet. The vortex flow chamber, together with the gas diverter nozzle, is used to apply a thermal pinch effect to the plasma jet to be output from the gas diverter nozzle.

7 Claims, 10 Drawing Figures

PLASMA JET GENERATING APPARATUS WITH PLASMA CONFINING VORTEX GENERATOR

BACKGROUND OF THE INVENTION

1. Field of the Invention

The present invention relates to a plasma jet generating apparatus.

In a plasma jet generating apparatus, an electric arc is formed between an electrode and a nozzle electrode. The thus formed electric-arc is then confined inside the nozzle with the aid of working gas under a thermal pinch effect for discharge of a high temperature plasma jet from the nozzle.

Very high energy can be concentrated in the plasma jet, in the form of temperatures as high as $10^4$ K and flow rates as high as $10^3$ m/s Thus, plasma jets can be widely applied for industry, engineering, and the like. At the present, plasma jets are being used in industry for fusion cutting or welding of stainless steels, alloys, and the like, spraying of metals and ceramics, melting and refining of pure metals and alloys, high temperature chemical reactions of polymers, and so on.

2. Description of the Related Art

Plasma jets provide very high efficiency in supplying heat energy. Accordingly, it is expected that higher power plasma jets will come into strong demand in the near future.

However, prior art plasma jet generating apparatuses have hithertofore been low in power, such as less than 100 kW. If one tries to use such low power apparatuses for high power plasma jets, the problem arises of rapid damage or consumption of the electrodes. This is believed to be due to the large-current, low-voltage driving nature of the prior art plasma jet generating apparatus. Anyway, it is very difficult to generate a high power plasma jet with the prior art apparatus.

SUMMARY OF THE INVENTION

Accordingly, an object of the preset invention is to provide an apparatus generating a plasma jet having a higher power than that in the prior art. A high temperature plasma jet, such as more than several MW in power, can be produced by the plasma jet generating apparatus according to the present invention.

To attain the above object, the plasma jet generating apparatus according to the present invention has two basic features. First, it uses electrodes arranged in tandem. Second, it uses a high speed vortex gas flow. Thus, a plasma jet can be confined under the thermal pinch effect by the vortex gas flow, which enables protection of each electrode from the jet. Also this enables production of a large amount of the high temperature plasma jet.

BRIEF DESCRIPTION OF THE DRAWINGS

The above object and features of the present invention will be made more apparent from the following description of the preferred embodiments with reference to the accompanying drawings, wherein.

DESCRIPTION OF THE PREFERRED EMBODIMENTS

Figure 1:
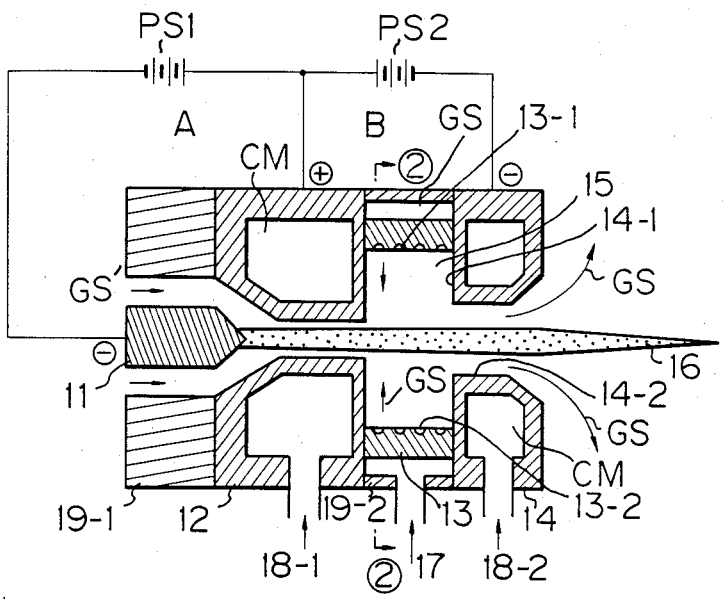
FIG. 1 is a cross-sectional view of a plasma jet generating apparatus according to a first embodiment of the present invention.

FIG. 1 is a cross-sectional view of a plasma jet generating apparatus according to a first embodiment of the present invention. The apparatus of the first embodiment is basically built as two parts A and B. Part A has substantially the same construction as a conventional plasma jet generating apparatus. Part B is a vortex flow/discharge unit newly employed according to the present invention.

As seen from FIG. 1, part A is comprised of a torch center electrode 11, made of, for example, tungsten, and a torch nozzle 12, also working as an electrode. The electrodes 11 and 12 are connected to one and the other end of a first DC power source PS1.

On the other hand, part B is comprised of a second DC power source PS2, one end of which is connected to the torch nozzle 12, the other end being connected to the gas diverter nozzle working as an electrode, and a vortex flow producing nozzle 13 having through-holes 13-1, in which nozzle a vortex flow chamber 15 is formed. Reference numeral 14 designates a gas diverter nozzle having a donut-shaped side wall 14-1 and an inside wall 14-2, 16 a plasma jet to be generated, 17 an inlet of a passage to which a working gas GS is supplied, 18-1 and 18-2 inlets of passages in which cooling media CM are accommodated, and 19-1 and 19-2 insulators.

Figure 2:
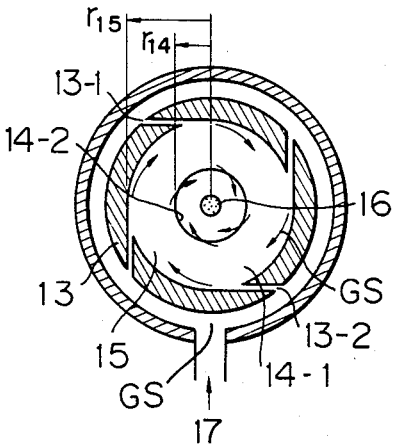
FIG. 2 is a cross-sectional view taken along line ②-② in FIG. 1.

FIG. 2 is a cross-sectional view taken along line ②-② in FIG. 1. FIG. 2 is used for understanding the operations performed inside the vortex flow/discharge unit B. The working gas GS is injected through the through-holes 13-1, 13-2 inside the vortex flow chamber 15. The vortex flow chamber 15 is of a cylindrical shape. The through-holes 13-1, 13-2 are preferably oriented in a tangential direction relative to the circle of the related cylindrical wall of the chamber 15. Also, the through-holes 13-1, 13-2 are positioned symmetrically with each other with respect to the longitudinal axis of the cylindrical wall of the chamber 15.

The thus injected working gases, illustrated schematically as arrows in FIG. 1 and FIG. 2, turn fast to form the high speed vortex flow inside the vortex flow chamber 15. Then, the injected working gases are exhausted outside by way of the donut-shaped side wall 14-1 of the gas diverter nozzle 14 and the inside wall 14-2 of the nozzle.

Figure 3:
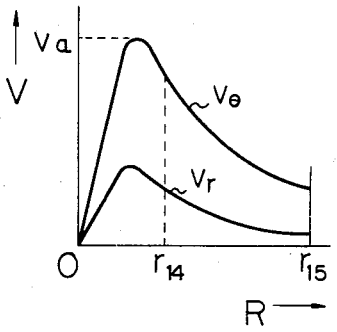
FIG. 3 is a graph of the velocity characteristics of the high speed vortex flow of the working gases.

FIG. 3 is a graph of the velocity characteristics of the high speed vortex flow of the working gases. In the graph of FIG. 3, the abscissa indicates the radius R and the ordinate a velocity V. The characters $r_{14}$ and $r_{15}$ along the abscissa represent the radii of the gas diverter nozzle 14 (14-2) and the vortex flow chamber 15. The character $v_a$ indicates the speed of sound. The characteristic curve $v_\theta$ represents the velocity in the tangential direction, while $v_r$ represents the velocity in the radial direction.

As seen from the graph of FIG. 3, the velocities of both the tangential and radial directions, i.e., $v_\theta$ and $v_r$, increase rapidly. The tangential velocity $v_\theta$ reaches the speed of sound $v_a$ due to a so-called "side wall" effect, i.e., the confinement effect against the vortex gas flow by the donut-shaped side wall of the gas diverter nozzle 14. At this time, the flow velocity measured inside the chamber 15 is made constant due to the so-called "viscosity effect of gas."

In this case, the inner side of the chamber 15 exhibits a relatively low pressure, which causes a steep gradient in gas pressure in the radial direction. This low pressure provides a vortex gas tunnel. Even though the outer side of the vortex gas flow assumes a pressure as high as above atmospheric pressure, the inner side thereof can assume a pressure as low as the order of several Torrs. Incidentally, the above-mentioned vortex gas tunnel has already been reported in Journal of the Physical Society of Japan, volume 43, No. 3, P.1107 to P.1108 September 1977, entitled "Concept of Vortex Gas Tunnel and Application to High Temperature Plasma Production", by the inventor Arata of the present application.

Since the vortex gas tunnel is formed along the center axis of the gas diverter nozzle 14, a strong thermal pinch effect is applied, due to convection in the radial direction, to the plasma jet 16. In addition, the stability of the plasma jet can be remarkably improved by a gas wall forming therein a steep gradient in pressure, which steep gradient is derived from the high speed vortex gas flow. Therefore, in FIG. 1, when pilot arc plasma is produced by an electric discharge arc between the torch center electrode 11 and the torch nozzle 12 and the thus produced pilot arc plasma runs through the vortex gas tunnel, the pilot arc plasma is subjected to large electric power through an electric discharge between the torch nozzle 12 and the gas diverter nozzle 14. Simultaneously, the pilot arc plasma is subjected to a strong thermal pinch effect, because the surface of the arc is cooled by the strong vortex gas flow. Therefore, a high power and high density plasma jet is created and exhausted outside the gas diverter nozzle 14. The inventors call such discharge at the center side of the vortex flow chamber 15 the "gas tunnel discharge."

Experiments using a prototype apparatus according to the first embodiment (FIG. 1) provided the following data. First, a plasma jet having positive polarity is energized by the gas diverter nozzle 14, to which negative polarity is applied by the power source PS2, as illustrated in FIG. 1. In this case, an electric potential −160 V is applied, after triggering the pilot arc plasma, to the gas diverter nozzle 14. It was found that an electric current can easily be superposed onto the plasma jet. For example, an electric current of 1300 A at 160 V can be superposed onto ordinary pilot arc plasma, such as 800 A at 35 V. As seen from the above experiment, a high electric power of over 200 kW can easily be emitted, via the gas diverter nozzle 14, to pilot arc plasma with an ordinary low electric power of less than 30 kW. Thus, the plasma jet to be generated greatly increases in length and brightness.

In the plasma jet generating apparatus according to the first embodiment of FIG. 1, the second DC power source PS2 can supply positive voltage ⊕ to the gas diverter nozzle 14 instead of negative voltage ⊖ as illustrated in this figure. Further, regarding the supply voltage of the second DC power source PS2, the voltage level can be freely determined in accordance with various parameters, for example, the length of the vortex flow chamber 15, the inner diameter of the gas diverter nozzle 14, the types of working gases for the vortex flow, and the flow amount and pressure of the working gas for the vortex flow. This means there is large freedom for enlarging the plasma jet power. More specific conditions are as follows.

(a) The working gas for the vortex flow may be composed of one selected from the group consisting of, for example, Ar, He, $H_2$, $N_2$, $CO_2$, air, and chemical reactive gas. It should be understood here that it is not always necessary to choose the same material both for the working gas GS as the vortex gas flow and the working gas GS' as the gas for creation of the pilot arc plasma.

(b) The voltage to be applied between the torch nozzle 12 and the gas diverter nozzle 14, i.e., $V_{12\text{-}14}$, increases along with an increase of the vortex flow chamber 15 in length.

Figure 4:
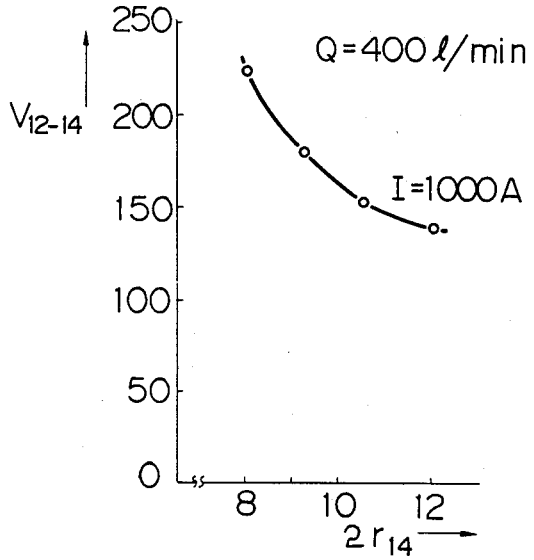
FIG. 4 is a graph of the relationship between the inner diameter of a gas diverter nozzle and a voltage applied between two nozzles of a part of the apparatus.

(c) The voltage $V_{12\text{-}14}$ changes indirectly in inverse proportion to the change of inner diameter of the gas diverter nozzle 14. FIG. 4 is a graph showing the relationship between the inner diameter of the gas diverter nozzle 14 and the voltage $V_{12\text{-}14}$ applied between the two nozzles of part B. As clear from the graph of FIG. 4, the voltage $V_{12\text{-}14}$ is indirectly proportional to the inner diameter (in mm) of the gas diverter nozzle 14. The relationship of the graph is obtained, in this case, under a condition where the gas flow rate Q is about 400 l/min and an electric current I of the source PS2 is about 1000 A.

(d) The voltage $V_{12\text{-}14}$ changes in direct proportion to the change of the gas flow rate in the gas diverter nozzle 14.

Figure 5:
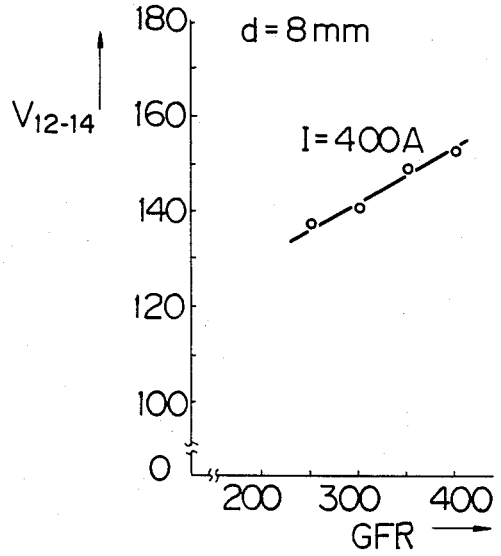
FIG. 5 is a graph of the relationship between the gas flow rate in a gas diverter nozzle and a voltage between the two nozzles.

FIG. 5 is a graph of the relationship between the gas flow rate GFR in the gas diverter nozzle and the voltage $V_{12\text{-}14}$ between the two nozzles of the part B. As clear from the graph of FIG. 5, the voltage $V_{12\text{-}14}$ increases along with an increase of the gas flow rate GFR (in l/min). The relationship of the graph is obtained, in this case, under the conditions of an about 400 A electric current I of the source PS2 of and an 8 mm inner diameter d of the gas diverter nozzle 14.

(e) The voltage $V_{12\text{-}14}$ also varies depending on the variety of the working gas GS. For example, the voltage $V_{12\text{-}14}$ when $N_2$ is used as the working gas is higher than that when Ar is used as the working gas.

(f) The change in the pressure of the working gas also induces a change in the voltage $V_{12\text{-}14}$. The change is found to be identical to a case where the voltage $V_{12\text{-}14}$ is changed by the change of the gas flow rate, as in FIG. 5.

As previously mentioned, it is easy for the plasma jet generating apparatus of the present invention to output a very high power plasma jet. The reason for this will be clarified with reference to FIG. 6.

Figure 6:
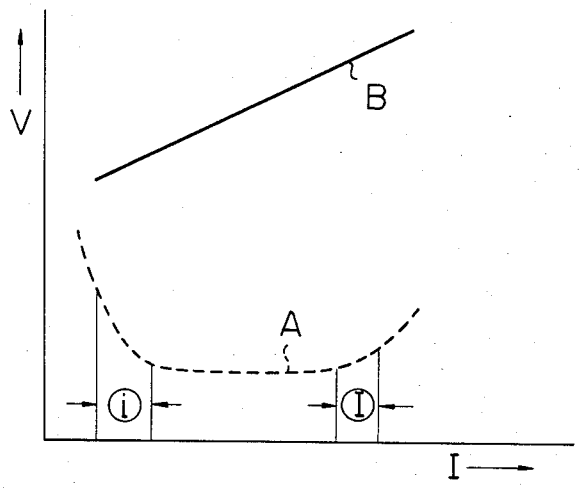
FIG. 6 is a graph of two characteristics in relation to both the voltage and electric current.

FIG. 6 is a graph displaying two characteristics in relation to both voltage and electric current. The ordinate and abscissa of the graph correspond to the voltage V and the electric current I both appearing across the plasma jet. The broken line curve A indicates a typical and conventional V-I characteristic provided from a prior art plasma jet generating apparatus having a construction similar to part A in FIG. 1. The solid line curve B indicates a characteristic provided by the present invention, which is featured as a characteristic attained in a gas tunnel discharge region, while the broken line curve A may be defined as a characteristic attained in a usual plasma jet region, which appears in the range ⓘ of the graph in FIG. 6. As seen from the graph, the range ⓘ exhibits a so-called negative characteristic be the variables V and I. This characteristic is also obtained in the apparatus of FIG. 1 only at an initial stage where the pilot arc plasma is to be generated first, but in the prior art plasma jet generating apparatus, the same characteristic is obtained throughout the usual working time. If one tries to increase the plasma jet power from the prior art apparatus, one must utilize a positive characteristic between the variables V and I. This positive characteristic can be obtained, in the graph, at the range Ⓘ. Therefore, a very large current is needed therefore. The electrodes suffer from undesired fusion due to such a large current.

Contrary to the above, according to the present invention, the intended increase in plasma jet power can easily be performed by using the positive characteristic inherent to the gas tunnel discharge region, i.e., the solid line curve B in the graph. It should be noted that, in the gas tunnel discharge region, the V-I characteristic is made positive due to the aforesaid strong thermal pinch effect. Consequently, the apparatus of the present invention is suitable for a large electric current, in addition, with voltage on the order of over 100 V, which is higher than the working voltage of the usual plasma jet, for example, the order of about 50 V.

Figure 7:
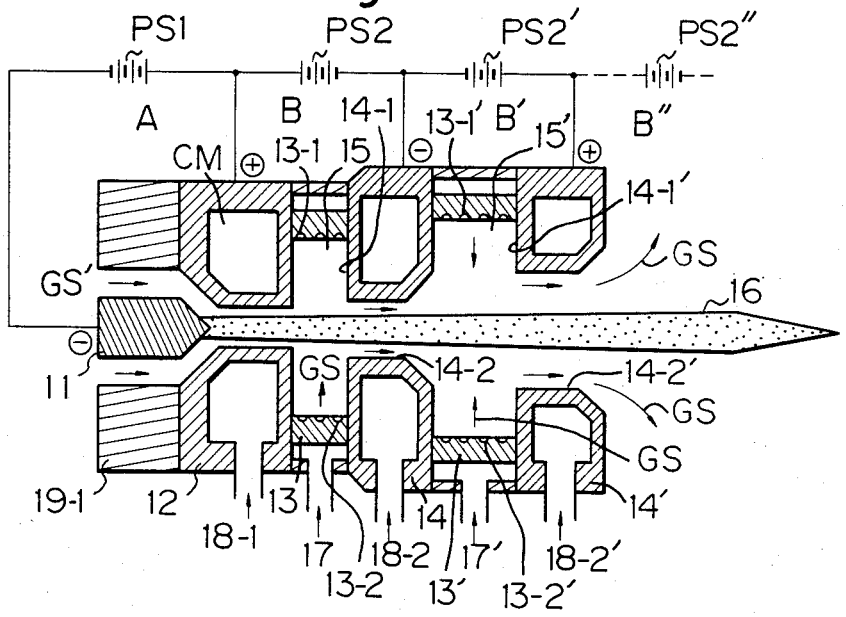
FIG. 7 is a cross-sectional view of a plasma jet generating apparatus according to a second embodiment of the present invention.

FIG. 7 is a cross-sectional view of a plasma jet generating apparatus according to a second embodiment of the present invention. In FIG. 7, members the same as those of FIG. 1 are represented by the same reference numerals or characters (same for later figures). As understood from FIG. 7, the vortex flow/discharge unit B is further connected, in tandem along the flow of the plasma jet 16, with a further vortex flow/discharge unit B′ or units (B′, B″ . . .), each having almost identical constructions. The thus added vortex flow/discharge unit B′ (or units B′, B″) is operative to multiply the energy of the plasma jet 16, which enables creation of an ultra high power plasma jet generating apparatus. If the plasma jet generating apparatus is set up with three vortex flow/discharge units B, B′, and B″ (not illustrated completely) connected in tandem, it can work as a 3 MW powered apparatus with 2 kA at 1.5 kV.

Figure 8:
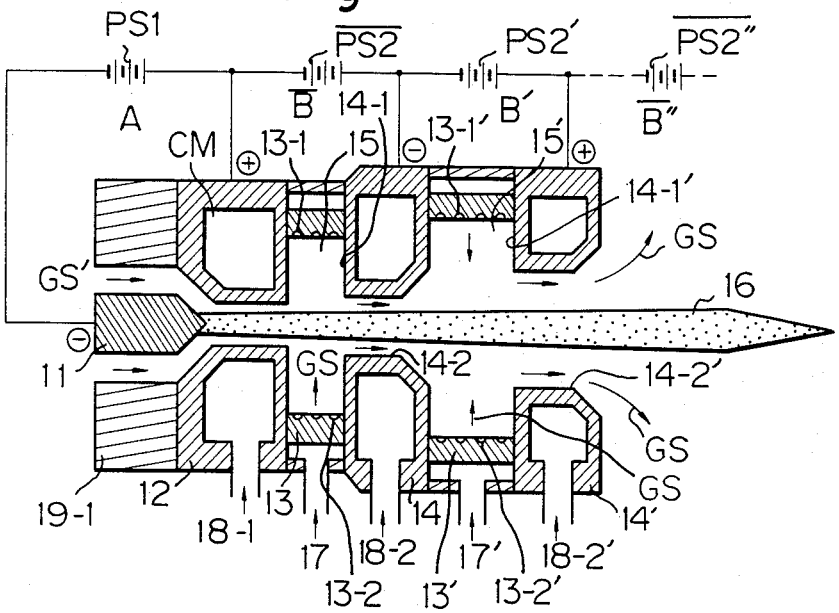
FIG. 8 is a sectional-view of a modified a plasma jet generating apparatus based on the second embodiment of FIG. 7.

FIG. 8 is a sectional view of a modified plasma jet generating apparatus based on the second embodiment of FIG. 7 according to the present invention. In the apparatus of FIG. 7, the second DC power sources PS2, PS2′, and PS2″ of the vortex flow/discharge units B, B′, and B″ (not completely illustrated) are connected in the same polarity as each other. However, in the apparatus of FIG. 8, the second DC power sources $\overline{PS2}$, PS2′, and $\overline{PS2''}$ for the vortex flow/discharge units $\overline{B}$, B′, and $\overline{B''}$, respectively are arranged alternately with opposite polarities.

The plasma jet generating apparatus of FIG. 7 is superior in thermal efficiency to that of FIG. 8 by several %. The reason for this, however, is not completely clear at present theoretically.

Figure 9:
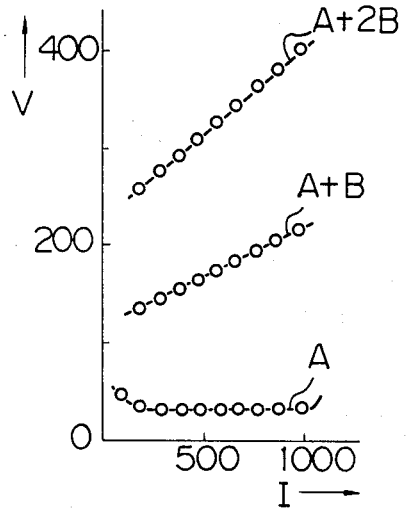
FIG. 9 is a graph of V-I characteristics of the plasma jet.

FIG. 9 is a graph of the V-I characteristics of the plasma jet. The abscissa and ordinate indicate the electric current I in A and the voltage V. In the graph, the characteristic curve A corresponds to a prior art plasma jet generating apparatus, i.e., having only the part A of FIG. 1, the characteristic curve "A+B" to a single-stage plasma jet generating apparatus, i.e., the apparatus of FIG. 1 (indicating the voltage at the part B only), and the characteristic curve "A+2B" to a double-stage plasma jet generating apparatus, i.e., the apparatus of FIG. 7 or FIG. 8 (indicating the voltage at the parts B+B′ (or $\overline{B}$+B′) only when constructed in the form of A+B+B′ (or A+$\overline{B}$+B′)), in which, for example, the first DC power source had a supply voltage of 100 V and each second DC power source was a voltage of 500 V.

As understood from the above, the vortex flow chamber 15 plays a most important role in the present invention. The chamber 15 is, in actuality, formed by sandwiching the vortex flow generating nozzle (13, 13′) between two electrode nozzles.

Figure 10:
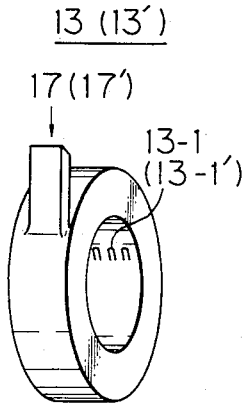
FIG. 10 is a perspective view of the vortex flow generating nozzle.

FIG. 10 is a perspective view of the vortex flow generating nozzle. In FIG. 10, the vortex flow chamber concerned is formed inside the nozzle (13, 13′). The inner cylindrical wall is provided with through-holes, such 13-1, 13-1′, 13-2, 13-2′, for injecting therefrom the working gas given from the inlet (17, 17′) through the passage contained in the nozzle (13, 13′).

As explained above in detail, the plasma jet generating apparatus can produce a large amount of high temperature plasma jet stably without expensive, complicated hardware. This is made possible by the thermal pinch effect and high insulation capability, both derived from the special vortex gas flow. The plasma jet generating apparatus therefore enables new applications as well, such as melting and refining of metals having extremely high melting points and conversion of toxic industrial waste from manufacturing factories to non-toxic material.

We claim:

1. A plasma jet generating apparatus comprising:

a torch center electrode;

a torch nozzle having first and second ends and into the first end of which said torch center electrode is directed;

a first DC power source connected across the first and the second ends of said torch nozzle for producing a plasma jet in cooperation with a working gas caused to flow through said torch nozzle; and a vortex flow/discharge unit connected to said second end of said torch nozzle, said unit comprising:

a second DC power source, one end of which is connected to said torch nozzle;

a gas diverter nozzle spaced from the second end of said torch nozzle and to which the other end of said second DC power source is connected; and a vortex flow chamber connected between said gas diverter nozzle and said torch nozzle, said chamber having a cylindrical shape defined by a cylindrical wall, said cylindrical wall having a plurality of sets of at least four through holes extending therethrough tangentially to the inside cylindrical surface of said cylindrical wall, the through holes of each set being spaced around the periphery of said cylindrical wall and the holes in each set being aligned with corresponding holes in the other sets along lines on the cylindrical wall which are parallel to the cylindrical axis of said chamber, said chamber having a donut-shaped end wall perpendicular to the cylindrical wall and on the end remote from said torch nozzle, said end wall being constituted by the end wall of said gas diverter nozzle which is toward said torch nozzle; and means for directing a working gas under pressure through said through holes into said vortex flow chamber for forming a vortex gas tunnel of the working gas enclosing the plasma jet therein, whereby the plasma jet is subjected to a thermal pinch effect through the gas tunnel and the plasma jet is produced while maintaining thermal isolation of the plasma jet from the inside wall of the gas diverter nozzle.

2. A plasma jet generating apparatus as claimed in claim 1 in which said working gas directing means comprises means for supplying said working gas into said through holes at a velocity of at least 100 m/sec.

3. A plasma jet generating apparatus as claimed in claim 2 in which said working gas directing means comprises means for supplying said working gas into said through holes at a flow rate of at least 200 l/min.

4. A plasma jet generating apparatus as claimed in claim 1 in which said gas diverter nozzle has a passage therein around the nozzle for accommodating a cooling medium therein.

5. A plasma jet generating apparatus as claimed in claim 1 further comprising at least one further vortex flow/discharge unit connected in series along the direction of the plasma jet, said further vortex flow/discharge unit having the same construction as said first mentioned vortex flow/discharge unit.

6. A plasma jet generating apparatus as claimed in claim 5 in which said second DC power sources of each of said vortex flow/discharge units are connected across said units with the same polarity.

7. A plasma jet generating apparatus as claimed in claim 5 in which said second DC power sources of adjacent vortex flow/discharge units are connected across the units with opposite polarity.I

* * * * *